US006471034B2

(12) United States Patent
Lunardi et al.

(10) Patent No.: US 6,471,034 B2
(45) Date of Patent: Oct. 29, 2002

(54) GUIDE DEVICE FOR ESCALATOR STEP OR MOVING WALKWAY PLATE

(75) Inventors: Gerhard Lunardi, Vienna (AT); Reinhard Pallinger, Vienna (AT)

(73) Assignee: Inventio AG, Hergiswill (CH)

( * ) Notice: Subject to any disclaimer, the term of this patent is extended or adjusted under 35 U.S.C. 154(b) by 0 days.

(21) Appl. No.: 09/812,368

(22) Filed: Mar. 20, 2001

(65) Prior Publication Data

US 2001/0023810 A1 Sep. 27, 2001

(30) Foreign Application Priority Data

Mar. 27, 2000 (EP) ..... 00810262

(51) Int. Cl.[7] ..... B66B 23/12

(52) U.S. Cl. ..... 198/333; 198/321; 198/326; 198/332

(58) Field of Search ..... 198/321–338

(56) References Cited

U.S. PATENT DOCUMENTS 4,064,986 A * 12/1977 Bertovich ..... 198/326
4,236,623 A * 12/1980 Ackert ..... 198/333
4,249,649 A * 2/1981 Kraft ..... 198/332
5,161,668 A * 11/1992 Datema et al. ..... 198/332
6,170,632 B1 * 1/2001 Shimura et al. ..... 198/334
6,234,295 B1 * 5/2001 Ogawa ..... 198/333
6,257,390 B1 * 7/2001 Tehrani ..... 198/326
6,273,235 B1 * 8/2001 Inoue ..... 198/330

FOREIGN PATENT DOCUMENTS

CH 332944 11/1958
GB 768304 2/1957

* cited by examiner

*Primary Examiner*—Douglas Hess
(74) *Attorney, Agent, or Firm*—Schweitzer Cornman Gross & Bondell LLP

(57) ABSTRACT

An escalator or moving walkway is provided with a guide device to maintain the positions of the steps or plates with respect to the escalator sides. A respective guide device is provided at each step side which guides the steps laterally in the horizontal direction and insures a minimum spacing of the step from the base plate of the escalator balustrade base. In the forward run portion of the step belt the guide device engages the base plate, while in the return run portions of the step belt, the guide device engages the side surface of a second guide for chain rollers.

3 Claims, 4 Drawing Sheets

GUIDE DEVICE FOR ESCALATOR STEP OR MOVING WALKWAY PLATE

The invention relates to an escalator or a moving walkway consisting of a support, a step belt with steps or a plate belt with plates for the transport of persons and/or articles, a balustrade which is held by means of a balustrade base, with a handrail, wherein a guide device is provided for lateral guidance of the step belt or the plate belt.

BACKGROUND OF THE INVENTION

There has become known from patent specification CH 332 944 a guide device for steps of an escalator, by means of which guide device the stair steps are laterally guided and aligned. The rollers of the stair steps, as well as the rails, are provided with an interfitting profiling. The rollers have guide borders along the edges, the rollers being guided between the guide borders. An improved embodiment shows rails with edge bevels, in which rollers with bevels fit.

With such a guide device a minimum play between rollers and rail is required so that the rollers are not excessively abraded. The profiling of the roller changes over the course of time due to abrasion, which has a direct, deleterious effect on the play of the lateral guide.

It is accordingly the purpose of the present invention to provide an improved step or plate belt guide device which has improved wear characteristics and maintains alignment of the belt over long periods.

BRIEF DESCRIPTION OF THE INVENTION

In accordance with the foregoing and other purposes and objects, an escalator or moving walkway constructed in accordance with the present invention comprises guide members having a member mounted to an edge of the step or plate of the step/plate belt and a guide element supported by the base member which projects laterally of the step edge a distance sufficient to maintain the desired spacing between the step edge and the escalator/moving walkway base. The guide element preferably is positioned to engage the balustrade base along the forward run portion of the belt and to engage chain roller guides along the return run portion of the belt, maintaining the step at the desired spacing therefrom. Guide members may be provided at both sides of the step or plate to center the step/plate within the escalator/walking. Compensation can be provided for the mounting of the guide members to accommodate unevenness of the base and wear. Running smoothness and travel comfort for the escalator/walkway are substantially improved by the invention.

BRIEF DESCRIPTION OF THE DRAWINGS

The present invention is explained in more detail in the following description in conjunction with the annexed drawings illustrating embodiments thereof, wherein.

DETAILED DESCRIPTION OF THE INVENTION

Figure 1:
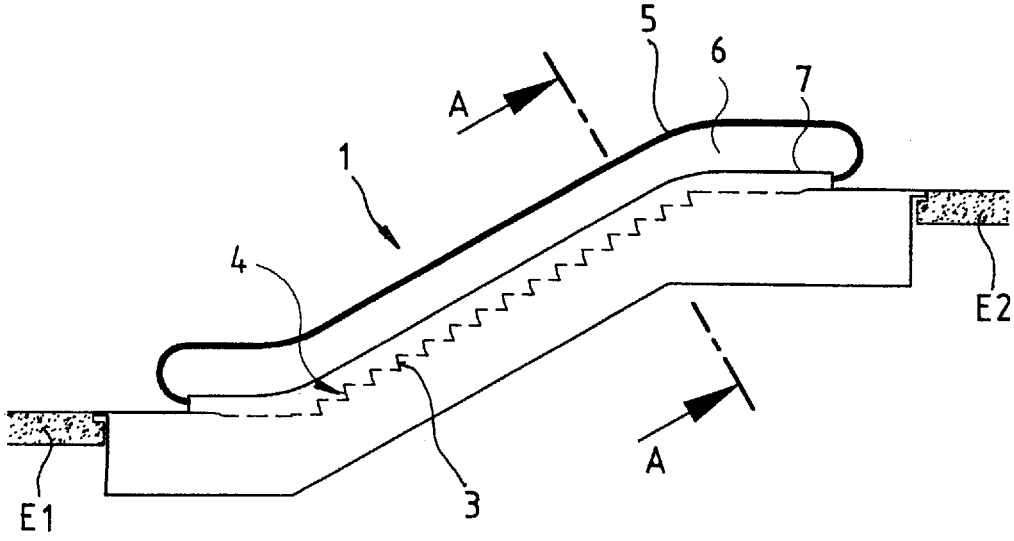
FIG. 1 is a side view of an escalator incorporating the invention.

FIG. 1 shows an escalator 1, or a moving walkway, connecting a first story E1 with a second story E2, having a step belt 4 consisting of steps 3 or alternatively with a plate belt consisting of plates (not shown). A handrail 5 is arrayed at a balustrade 6, which is supported at its lower end by means of a balustrade base 7. The balustrade base 7 is supported by a support 8 of the escalator 1 or the moving walkway. In the further course of description the term "escalator" is used instead of a reference to an "escalator or moving walkway", but the discussion applies in an analogous manner to a moving walkway apparatus as would be apparent to those skilled in the art.

Figure 2:
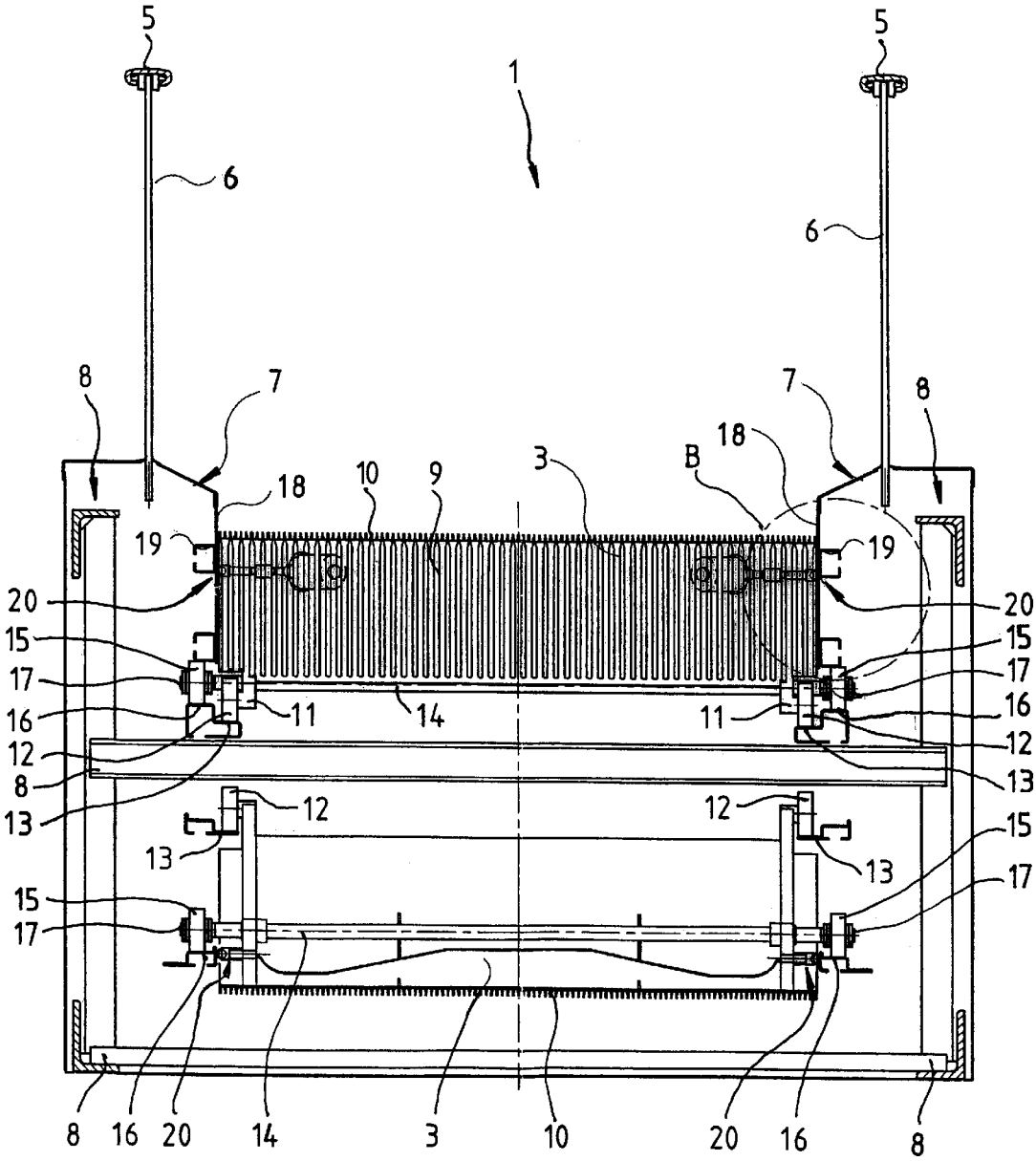
FIG. 2 is a detailed section of the escalator taken along the line A—A of FIG. 1.

FIG. 2 shows a section of the escalator along the line A—A of FIG. 1. The upper part of the escalator 1 includes the forward run portion of the step belt 4, which is in motion during escalator operation. The steps 3, with a visible front or riser part 9 and a tread surface 10, are upright and form an exposed stairway. The lower part of the escalator 1 includes the return run portion of the step belt 4, wherein the tread surface 10 is directed downwardly. Step rollers 12 arranged on arms 11 affixed to the steps are guided by means of first guides 13 arranged on the support 8. Chain rollers 15 on step axles 14 are guided by means of second guides 16 arranged on the support 8, wherein each step axle 14 is connected with a drivable step chain 17. The balustrade base 7 has at its inner step side a base plate 18, which is provided at its rear side with a reinforcement 19, for example a U-profile member. A respective guide device 20 is provided for each side of each of the steps, which device guides the step 3 laterally in the horizontal direction and ensures a minimum spacing of the step 3 from the opposed base plates 18 of the balustrade base 7. Along the forward run of the step belt 4 the guide device 20 may be in contact with the base plate 18 for guiding purposes, while along the return run portion of the step belt the guide device 20 may be in contact with a side surface of the second guide 16.

Figure 3:
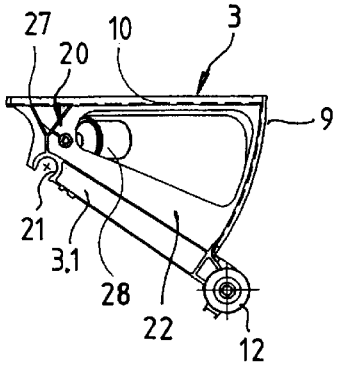
FIG. 3 is a side elevation view of a step of the escalator.
Figure 4:
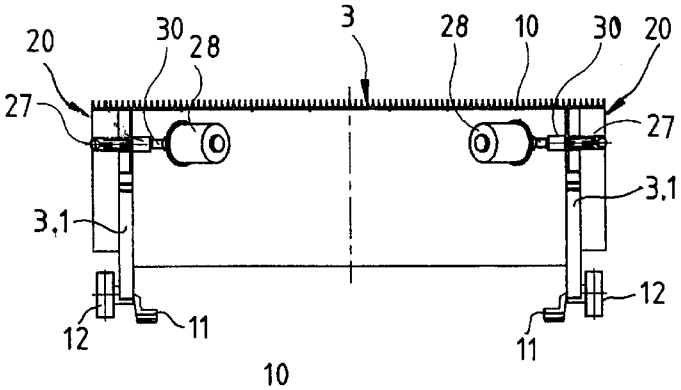
FIG. 4 is a rear elevation view of the step.
Figure 5:
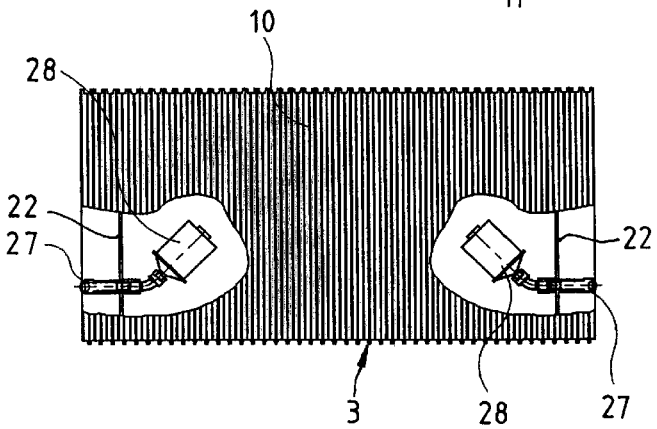
FIG. 5 is atop plan view of the step.

FIG. 3 is a side view of the step 3 together with the guide device 20 arranged above a step bearing 21. FIG. 4 is a view from the rear of the step, showing the guide device 20 arranged at a step rib 22. A step support 3.1 supports the step rib 22 and connects the step bearing 21 to the arm 11 of the step roller 12. FIG. 5 is a plan view of the step 3 together with the guide device 20. The specific embodiment of the guide device 20 shown in FIGS. 3 to 5 is explained in greater detail in conjunction with FIG. 8.

Figure 6:
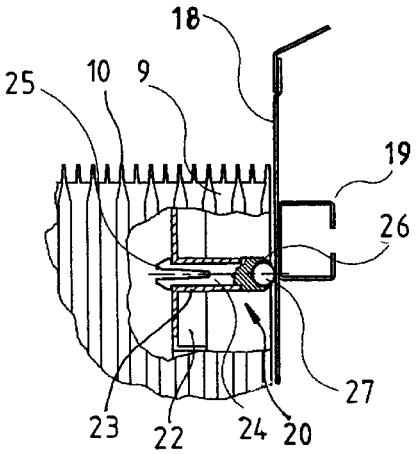
FIG. 6 is a partial elevation view of a step broken away to depict details of the guide device with a ball, as seen from the front of the step.
Figure 7:
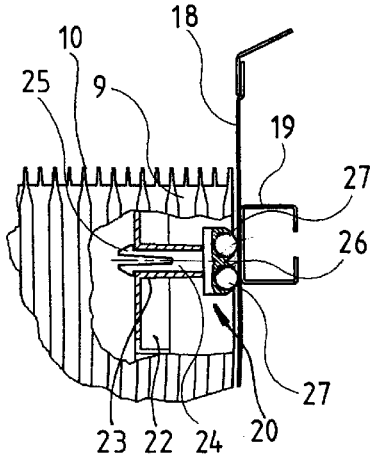
FIG. 7 is a partial elevation view of the step broken away to depict details of the guide device with two balls, as seen from the front part of the step.

FIGS. 6 to 12 show detail B of FIG. 2. FIG. 6 shows details of the guide device 20 as seen from the front 9 of the step 3. Arranged at the step rib 22 is a flange 23 in which a base part 24 of the guide merrier is inserted. At one end the base part 24 has hooks 25 which detent and engage with the step rib 22. At the other end of the base part 24 is a ball bearing 26 in which a ball 27 serving as a guide element is mounted. The ball 27 is engaged with and contacts the base plate 18, wherein the reinforcement 19 at the side of the base plate reinforces the base plate 18 in the support region of the ball against the force exerted by the ball 26 against the base plate as the guide member moves along the base plate. FIG. 7 shows the guide device 20 of FIG. 6 with two balls 27 engaging the base plate.

Figure 8:
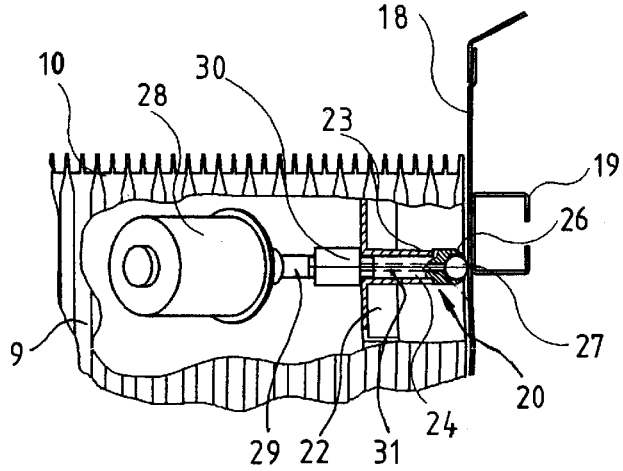
FIG. 8 is a partial elevation view of the step broken away to depict details of the guide device with a ball and with a lubricant container, as seen from the front of the step.
Figure 9:
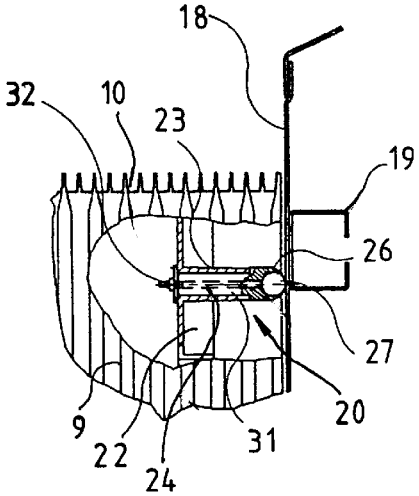
FIG. 9 is a partial elevation view of the step broken away to depict details of the guide device with a ball and with a lubricant nipple, as seen from the front of the step.

FIG. 8 shows an embodiment of the guide device 20 with a lubricant container 28, which is connected to the base part 24 by means of a curved pipe piece 29 and connecting sleeve 30. The lubricant container provides, over a longer period of time, lubricant which passes to the ball 27 by way of a lubricant bore 31 in the bearing 26. FIG. 9 shows the guide device 20 with a lubricant nipple 32, which is connected to the base part 24, allowing lubricant to be loaded into the interior of the base part for delivery to the ball 27. Permanent lubrication of the ball 27 can alternatively be provided.

Figure 10:
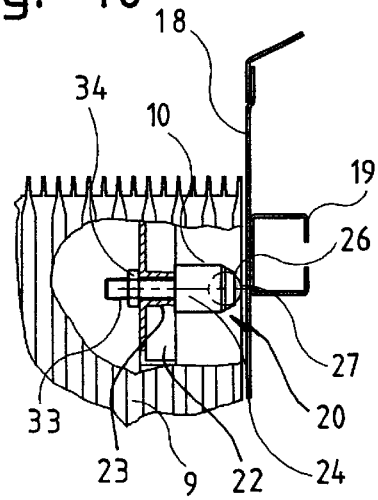
FIG. 10 is a partial elevation view of the step broken away to depict details of the guide device with a ball and with a thread, as seen from the front of the step.

FIG. 10 shows the guide device 20 in which the base part is provided with a threaded portion 33 and a widened head portion 24. Nut 34 secures the guide device 20 to the step rib 22 and flange 23.

Figure 11:
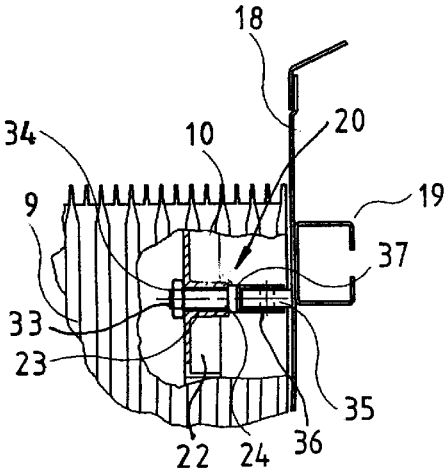
FIG. 11 is a partial elevation view of the step broken away to depict details of the guide device with a roller, as seen from the front of the step.
Figure 12:
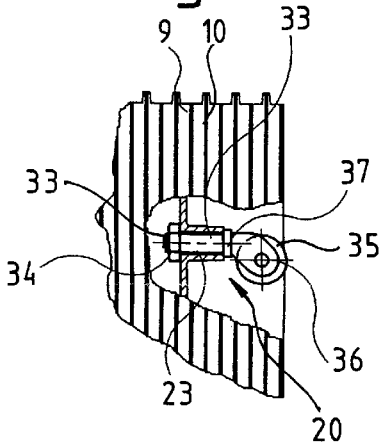
FIG. 12 is a top partial plan view of the step broken away to depict details of the guide device with a roller, as seen from the top tread surface of the step.

FIG. 11 and FIG. 12 show the guide device 20 with a roller 35 as a guide element in place of the ball(s) 27. The roller 35 is mounted upon a fork 36, which in turn is mounted upon a rotatable bearing 37. The bearing 37 is inserted into the flange 23 and is screw-connected with the step rib 22 by means of a threaded shank 33 and nut 34. With the rotatably mounted roller 35, steps 3 for escalators 1 with different angles of inclination can be accommodated.

In the illustrated examples, a respective guide device 20 is provided for each side of each of the steps. Several guide devices can also be provided for each side of a step.

We claim:

1. In an escalator or moving walkway of the type comprising a support, a step belt with steps or a plate belt with plates for the transport of persons and/or articles supported by the support, a balustrade which is held by means of a balustrade base affixed to the support, and a handrail mounted to the balustrade, the improvement comprising a guide device for lateral guidance of the step belt or the plate belt, the guide device being mounted at first and second opposed sides of the steps or plates, wherein the guide device guides the steps or the plates in a horizontal direction, the guide device comprising means for maintaining a minimum spacing of the step or plate from a base plate of the balustrade base during a forward run portion of step belt travel and for engaging a roller guide of the support during a return run portion of step belt travel, said means comprising an elongated hollow stem base member supported at a first end by the step or plate, and a guide element having at least one partially exposed ball mounted within the base member at a second end thereof for contacting the base plate and the roller guide to guide the step or plate therealong.

2. The improvement according to claim 1 further comprising lubricating means for the guide element, the lubricating means comprising the hollow stem base member.

3. The improvement according to claim 2, wherein the lubricating device further comprises a lubricant container or a lubricant nipple coupled to the hollow stem base member.

* * * * *